US010512944B2

(12) United States Patent
Rickey et al.

(10) Patent No.: US 10,512,944 B2
(45) Date of Patent: Dec. 24, 2019

(54) POWER WASHER WITH PULSING BOOST POWER MODE

(71) Applicant: TTI (MACAO COMMERCIAL OFFSHORE) LIMITED, Macau (MO)

(72) Inventors: Todd Rickey, Chung (CN); Sven Eschrich, Berglen (DE)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 16/060,183

(22) PCT Filed: Apr. 8, 2016

(86) PCT No.: PCT/CN2016/078880

§ 371 (c)(1),
(2) Date: Jun. 7, 2018

(87) PCT Pub. No.: WO2017/096740

PCT Pub. Date: Jun. 15, 2017

(65) Prior Publication Data

US 2018/0361434 A1 Dec. 20, 2018

(30) Foreign Application Priority Data

Dec. 9, 2015 (HK) ..... 15112138.1

(51) Int. Cl.
*B08B 3/02* (2006.01)
*B05B 9/04* (2006.01)

(52) U.S. Cl.
CPC ..... *B08B 3/028* (2013.01); *B05B 9/04* (2013.01); *B08B 3/026* (2013.01); *B08B 2203/0223* (2013.01)

(58) Field of Classification Search
CPC .... B08B 3/028; B08B 2203/0223; B05B 9/04
See application file for complete search history.

(56) References Cited

U.S. PATENT DOCUMENTS

2004/0046044 A1* 3/2004 Bennett ..... B08B 3/026 239/146
2006/0245941 A1* 11/2006 Sharp ..... F04B 49/022 417/298

(Continued)

FOREIGN PATENT DOCUMENTS

CN 201230227 Y 4/2009
CN 101811122 A 8/2010

(Continued)

OTHER PUBLICATIONS

International Search Report and Written Opinion for Application No. PCT/CN2016/078880 dated Jun. 30, 2016 (7 pages).

(Continued)

*Primary Examiner* — Benjamin L Osterhout
(74) *Attorney, Agent, or Firm* — Michael Best & Friedrich LLP

(57) ABSTRACT

An electric power washer contains a main body having a pump and an electric power source, a hose, a handle, and a control circuit. The hose contains a first end fluidly-connected to the pump and a second end fluidly-connected to the handle, which has a button operatively-connected to the control circuit, which is operatively-connected to the pump and the electric power source. The control circuit controls the pump output and contains a timer. The control circuit permits the pump to normally operate at up to 100% normal power. However, when the button is activated, the control circuit permits the pump to operate at a boost power mode of from about 103% normal power to about 300% normal power. The control circuit intermittently pulses the boost power mode and terminates the boost power mode after a predetermined period of time or when the button is no longer activated, whichever is shorter.

20 Claims, 1 Drawing Sheet

(56) References Cited

U.S. PATENT DOCUMENTS

| | | | | |
|---|---|---|---|---|
| 2006/0254008 | A1* | 11/2006 | Hahn | A47L 11/26 15/50.3 |
| 2007/0125878 | A1* | 6/2007 | Hahn | B08B 3/026 239/332 |
| 2008/0245425 | A1* | 10/2008 | Alexander | B08B 3/026 137/565.13 |
| 2009/0045271 | A1* | 2/2009 | Alexander | B08B 3/026 239/722 |
| 2009/0116972 | A1 | 5/2009 | Gilpatrick et al. | |
| 2011/0036418 | A1* | 2/2011 | Hendy | B08B 3/02 137/335 |
| 2012/0234939 | A1 | 9/2012 | Bearup et al. | |
| 2013/0276751 | A1* | 10/2013 | Raasch | F02M 1/02 123/352 |
| 2015/0050169 | A1 | 2/2015 | Horie et al. | |
| 2015/0096206 | A1* | 4/2015 | Raasch | F02M 1/02 37/244 |
| 2015/0251223 | A1 | 9/2015 | Horie et al. | |
| 2016/0016207 | A1* | 1/2016 | Horie | B08B 3/026 134/174 |
| 2017/0361357 | A1* | 12/2017 | Raasch | B08B 3/02 |

FOREIGN PATENT DOCUMENTS

| | | | |
|---|---|---|---|
| CN | 104520024 | A | 4/2015 |
| CN | 204320542 | U | 5/2015 |
| DE | 9201525 | U1 | 7/1992 |
| DE | 102008012357 | A1 | 3/2009 |
| EP | 0504568 | A1 | 9/1992 |
| EP | 0917912 | A2 | 5/1999 |
| JP | H06126249 | A | 5/1994 |
| WO | 2013123966 | A1 | 8/2013 |
| WO | 2014000824 | A1 | 1/2014 |
| WO | 2015194426 | A1 | 4/2017 |
| WO | 2017096740 | A1 | 6/2017 |

OTHER PUBLICATIONS

European Patent Office Partial Search Report for Related Application No. 16891110.5 dated Sep. 30, 2019 (13 pages).

* cited by examiner

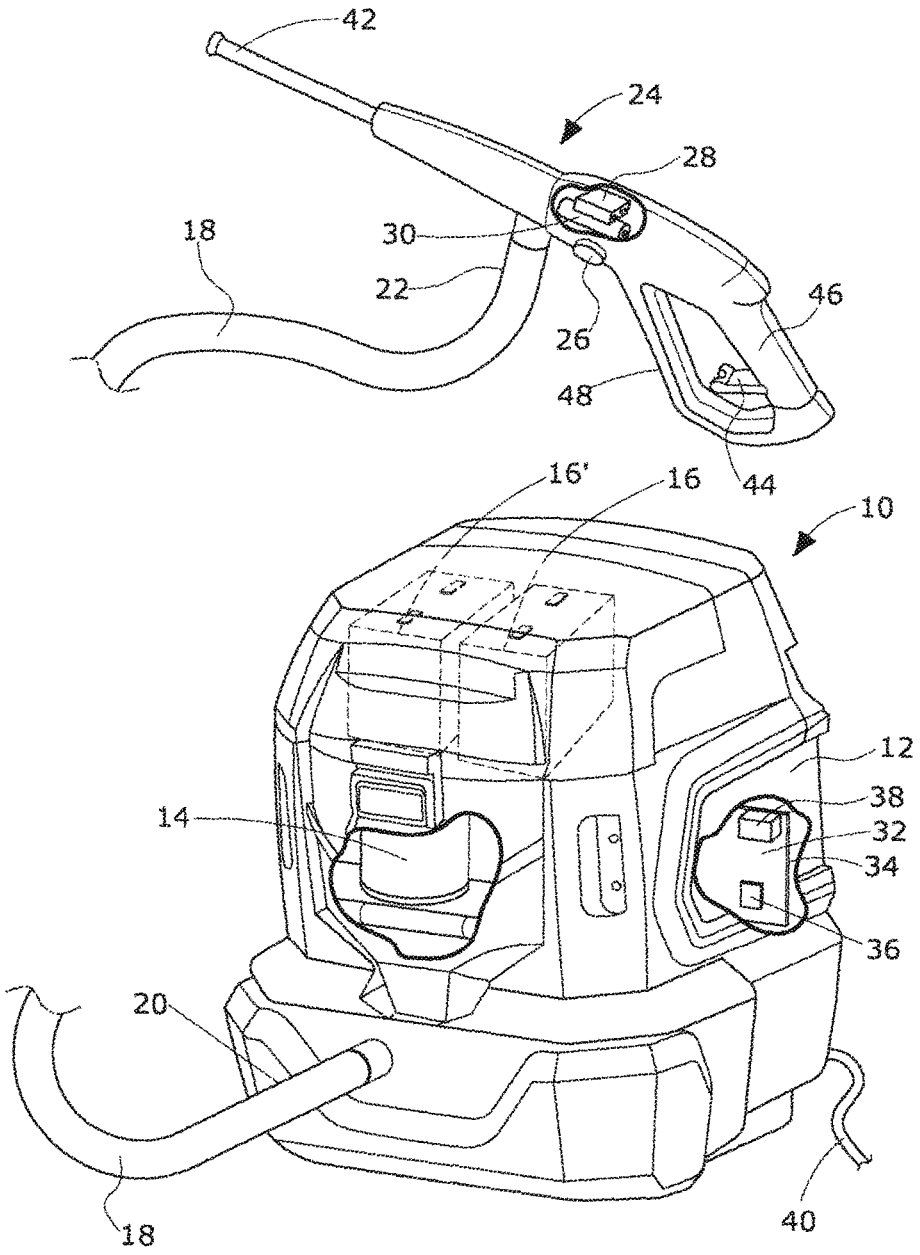
42
24
28
18
30
22
26
46
48
44
16'
16
10
12
38
14
32
34
36
20
18
40

POWER WASHER WITH PULSING BOOST POWER MODE

CROSS-REFERENCE TO RELATED APPLICATIONS

The present application is a national stage filing under 35 U.S.C. 371 of International Application No. PCT/CN2016/078880 filed Apr. 8, 2016, which claims priority to Hong Kong Patent Application No. 15112138.1 filed Dec. 9, 2015, the entire contents of both of which are hereby incorporated by reference herein.

FIELD OF THE INVENTION

The present invention relates to power washers.

BACKGROUND

Power washers are typically used to provide a high pressure water stream to clean surfaces such as walls, sidewalks, cars, etc. The water from a reservoir or a hose is passed through a pump which creates a high pressure stream which flows through a hose to a wand. The stream exits and is directed with the wand. Typically the wand has a handle which allows the user to easily and securely hold the wand, because as the water exits the wand with great velocity, it exerts a strong force pushing back on the wand.

Power washers are increasingly popular to clean materials such as concrete, wood, plastics, and metals. Typically a power washer has one or more power settings and a setting which is its maximum normal power setting. This setting is specific for each individual washer, as it is determined by a variety of factors such as the internal safety tolerances, pump power, hose tolerances, etc.

Electric power washers are also becoming increasingly popular, and may be either AC powered or DC (i.e., battery) powered. AC powered washers are typically plugged into the local power grid, while DC powered washers may be run on high-voltage batteries alone.

In certain instances, however, the typical maximum setting may be considered by the user to be insufficient to wash away and/or dislodge certain debris. Accordingly, the need exists for a boost power mode to provide a higher pressure water stream.

SUMMARY OF THE INVENTION

The present invention relates to an electric power washer containing a main body, a hose, a handle, and a control circuit. The main body contains a pump and an electric power source operatively-connected to the pump. The hose contains a first end that is fluidly-connected to the pump and second end fluidly-connected to the handle. The handle has a button operatively-connected to the control circuit. The control circuit is operatively-connected to both the pump and the electric power source. The control circuit controls the output of the pump. The control circuit contains a timer as well. The control circuit permits the pump to normally operate at up to 100% normal power. However, when the button is activated, the control circuit permits the pump to operate at a boost power mode of from about 103% normal power to about 300% normal power. The control circuit intermittently pulses the boost power mode.

A method for boosting the power of a pump on a power washer contains the steps of providing a control circuit operatively-connected to the pump, providing an electric power source operatively-connected to the control circuit, providing a boost power mode, and terminating the boost power mode. The control circuit controls the pump. The electric power source is operatively-connected to the pump and the control circuit permits the pump to normally operate at up to 100% normal power. However, in the boost power mode, the control circuit permits the pump to operate at from about 103% normal power to about 300% normal power; or from about 105% normal power to about 250% normal power; or from about 110% normal power to about 200% normal power.

Without intending to be limited by theory, it is surprisingly-believed that such a boost power mode and a method for using such a boost power mode provides a limited burst of increased power and therefore increased water pressure/water output, without causing any significant, lasting damage to the battery, the internal mechanisms, the pump, seals, etc. It is further believed that such a limited boost power mode specifically does not cause significant and/or lasting damage to an electric battery such as a lithium ion battery. Without intending to be limited by theory, it is also believed that an intermittently pulsing boost power mode more easily dislodges dirt and grime, while balancing wear and tear on the power washer components such as, for example, the battery, the pump, the seals, the motor, etc.

The boost power mode is terminated after a predetermined period of time, or when the button is no longer activated, whichever period is shorter. The predetermined period of time may be from about 2 seconds to about 10 minutes; or from about 5 seconds to about 2 minutes; or from about 7 seconds to about 1.5 minutes; or from about 10 seconds to about 1 minute; or from about 15 seconds to 45 seconds.

Without intending to be limited by theory, it is believed that the present invention allows the user greater control, and also reduces the change of damage to the battery, the pump, and/or the internal mechanisms of the power washer. In addition, some consumers prefer such a pulsing boost function as the consumer perception is that it more effectively cleans and dislodges dirt and grime. Such a feature provides improved performance while maintaining the safety and reliability of the power washer.

BRIEF DESCRIPTION OF THE DRAWINGS

The FIGURE shows a partially cut-away view of an embodiment of the power washer of the present invention.

The FIGURE herein is for illustrative purposes only and is not necessarily drawn to scale.

DESCRIPTION OF THE PREFERRED EMBODIMENTS

Unless otherwise specifically provided, all tests herein are conducted at standard conditions which include a room and testing temperature of 25° C., sea level (1 atm.) pressure, pH 7, and all measurements are made in metric units. Furthermore, all percentages, ratios, etc. herein are by weight, unless specifically indicated otherwise.

An electric power washer typically has a normal power range in which it provides 100% of normal power. For an electric power washer this 100% normal power is typically determined by the maximum sustainable draw from the batteries or the AC power source. In the case of batteries, the maximum sustainable draw from the batteries is limited because as power is drawn out faster and faster, the batteries will tend to heat up. Many batteries, such as lithium ion batteries can become damaged or inoperative when subject to high temperatures over an extended period of time. Accordingly, engineers design equipment such that it only draws power from the batteries at a level which would keep the batteries at a stable temperature or a temperature beyond which, if sustained, damage is thought to occur to the battery; designers are thus inherently are biased towards maintaining lower battery temperatures and do not want to cause the batteries to overheat and thereby exceed the safety parameters and tolerances of the batteries themselves.

In the case where batteries are not present, and/or where a battery is not the main power source of the power washer, then the designer may want to limit power so as not to burn out pump and/or cause permanent damage to the pump and/or other internal mechanisms of the power washer such as the seals, etc.

Alternatively, the designer may wish to limit the power washer's power so as to improve safety of the power washer itself during use, as the spray and water exiting the power washer may exert significant backward force against the user leading to a loss of control for certain users, careless users, and those unprepared for the level of force exerted.

The 100% normal power is therefore defined as the highest sustainable power draw which will not permanently damage the batteries, motor or the pump.

However, it has been found that when drawing extra power from such the electric power source; or a battery, if the overheating is for a short, limited amount of time, then the batteries can recover without adversely affecting the batteries and their long term safety. Without intending to be limited theory, the inventors, upon realizing that a short period of excess heat and/or high pressure is not overly harmful to the batteries, motor, pump, internal mechanisms, and/or seals, challenged the common knowledge in the art. The inventors therefore believe that this bending of the normal practice of designing battery-powered equipment surprisingly allows the batteries to provide a limited "boost power mode" which is more powerful than be sustainable 100% normal power mode, and which does not cause overt and/or unrecoverable damage to the power washer and the components therein.

In the case of an AC-power washer, it is believed that a boost power mode of a limited duration may not cause permanent damage to the pump and/or internal mechanisms of the power washer, and/or may be more controllable by a user.

Without intending to be limited by theory, it is believed that due to a common closed-minded mentality/blindness in the art of those skilled in power washer design, such a feature and method for achieving a boost power mode has not been previously-considered by tool designers, and especially designers of electric power washers, which draw a large amount of voltage from batteries, and which during use, the user may often desire a little bit more power for a limited amount of time.

Accordingly, the present invention relates to an electric power washer having a main body, a hose, a handle and a control circuit. The main body contains a pump and an electric power source; or a battery, where the pump is operatively-connected to the electric power source. The hose contains a first end in fluid connection with the pump and a second end. The second end is in fluid connection with the handle. The handle further contains a button operatively-connected to the control circuit. The control circuit is operatively-connected to the pump and to the electric power source and the control circuit controls the output of the pump. The control circuit further contains a timer operatively-connected to the control circuit and a receiver operatively-connected to the control circuit.

Under normal conditions, the control circuit permits the pump to operate at up to 100% normal power. However, when the button is activated, the control circuit permits the pump to exceed the 100% normal power, and to operate in a boost power mode. The control circuit may control the pump to operate either directly or indirectly as desired. In an embodiment herein, the control circuit controls the pump speed directly. In an embodiment herein, the control circuit controls the pump speed indirectly via, for example, by controlling the battery output.

The boost power mode may be from greater than about 100% normal power; or from about 103% normal power to about 300% normal power; or from about 105% normal power to about 250% normal power; or from about 110% normal power to about 200% normal power. In order to prevent damage to the battery, the control circuit intermittently pulses the boost power mode. The control circuit may intermittently pulse the boost power mode by, for example, controlling the pump speed, the motor speed, the battery output, and a combination thereof; or by controlling the pump speed.

In an embodiment herein, the control circuit then terminates the boost power mode after a predetermined period of time or when the button is no longer activated whichever is shorter; or wherein the predetermined period of time is from about 2 seconds to about 10 minutes; or from about 5 seconds to about 2 minutes; or from about 7 seconds to about 1.5 minutes; or from about 10 seconds to about 1 minute; or from about 15 seconds to 45 seconds. In an embodiment herein, the predetermined period of time is determined by analyzing the power washer's components' specifications and tolerances, power source(s), etc.

In an embodiment herein, the control circuit measures a characteristic of the power washer and adjusts the intermittent pulsing of the boost power mode based on the characteristic. For example, the characteristic may be the current usage, battery temperature, motor temperature, pump temperature, motor speed, pump speed, and a combination thereof; or current usage, battery temperature, and a combination thereof. If, for example, the current usage is too high, the battery temperature is too high, the motor temperature is too high, the pump temperature is too high, the motor speed is too high, the pump speed is too high, or a combination thereof, then the control circuit may adjust the intermittent pulsing of the boost power mode so as to reduce the battery usage, the battery output, the motor speed, the pump speed, etc. The adjustment may be, for example, to increase the time between pulses, to reduce the total number of pulses, to reduce the power of a pulse for example, by reducing the boost power mode), to reduce the length of a pulse, and a combination thereof; or by increasing the time between pulses, reducing the power of a pulse, and a combination thereof. Such an adjustment may be made either directly, indirectly, or both by the control circuit.

In an embodiment herein, the control circuit measures a characteristic of the power washer and adjusts the predetermined period of time based on the characteristic. For example, the characteristic may be the current usage, battery temperature, motor temperature, pump temperature, motor speed, pump speed, and a combination thereof, or current usage, battery temperature, and a combination thereof. If, for example, the current usage is too high, the battery temperature is too high, the motor temperature is too high, the pump temperature is too high, the motor speed is too high, the pump speed is too high, and a combination thereof, then the control circuit may adjust the predetermined period of the boost power mode. The adjustment may be, for example, to increase the time between pulses, to reduce the total number of pulses, to reduce the power of a pulse (for example, by reducing the boost power mode), to reduce the length of a pulse, and a combination thereof; or by increasing the time between pulses, reducing the power of a pulse, and a combination thereof. Such an adjustment may be made either directly, indirectly, or both by the control circuit. In an embodiment herein, the pulsing pattern alternates between a boost power mode spray for about 1 second and a normal 100% mode spray for from about ¼ seconds to about 1 second. In an embodiment herein, the pulsing pattern alternates between a boost power mode spray for about ½ seconds to about 5 seconds and a normal 100% mode spray for from about ½ seconds to about 5 seconds. In an embodiment herein, the pulsing pattern alternates between a boost power mode spray for about seconds to about 3 seconds and a normal 100% mode spray for from about ¼ seconds to about 5 seconds. In an embodiment herein, the pulsing pattern repeats for the predetermined period of time.

The button is operatively-connected to the control circuit. In an embodiment herein, the button is operatively-connected to the control circuit by wires. In an embodiment herein, the button is operatively-connected to a transmitter and a receiver is operatively-connected to the control circuit. In such an embodiment, the transmitter transmits a signal to the receiver in order to be operatively-connected. In an embodiment herein, when the button is activated, the transmitter continuously transmits the signal to the receiver. In an embodiment herein, when the button is activated, the transmitter transmits a start signal to the receiver, and when the button is deactivated, then the transmitter transmits a stop signal to the receiver. In such an embodiment, when the receiver receives the start signal, it signals the control circuit to start the boost power mode. When the receiver receives the stop signal receives the stop signal then the receiver signals the control circuit to stop the boost power mode.

The FIGURE shows a partially-cut-away embodiment of the present invention where a power washer, 10, is formed of a main body, containing a pump, 14. The main body will typically be made of a material selected from a plastic, a resin, rubber, metal, and a combination thereof; or a plastic, rubber, a metal and a combination thereof. The plastic herein may be a high impact plastic; or polyethylene, polypropylene, polystyrene, and a combination thereof; or linear low density polyethylene, low density polyethylene, high density polyethylene, and a combination thereof either with or without other co-monomers. The metal useful herein may be, for example, brass, steel (including stainless steel), iron, aluminium, other metals known in the art of power washers and power tools, and a combination thereof.

The pump useful herein is typically a high pressure electric pump having an output at 100% normal power of more than about 500 psi (3.4 MPa); or of from about 500 psi (3.4 MPa) to about 5000 psi (34 MPa); or from about 1000 psi (6.8 MPa) to about 4000 psi (27.6 MPa); or from about 1250 psi (8.6 MPa) to about 3500 psi (24.1 MPa). Such pumps are commonly available from many makers worldwide.

In this embodiment, two electric batteries, 16 and 16', are one electric power source for the pump, 14. The electric battery useful herein is typically a rechargeable electric battery having a voltage of more than 1 v; or from about v to about 56 v; or from about 1.5 v to about 48 v; or from about 3 v to about 45 v; or from about 6 v to about 40 v. The power washer herein includes at least one electric battery, or from about 1 to about 12 electric batteries; or from about 2 to about 8 electric batteries. In the FIGURE, it can be seen that the power washer, 10, contains 2 electric batteries, 16 and 16', each rated at about 18 v. The electric battery useful herein typically possesses a mAh rating of greater than 750 mAh; or from about 750 mAh to about 10000 mAh; or from about 1000 mAh to about 6000 mAh; or from about 1100 mAh to about 5000 mAh. The chemistry in the electric battery is largely irrelevant, but may be, for example nickel-cadmium, lithium ion, or a combination thereof; or lithium ion. Without intending to be limited by theory, it is believed that lithium-ion batteries are especially prone to damage due to overheating, and thus it is believed that the present invention helps to improve performance especially in cases where lithium ion electric batteries are used. The electric battery herein typically provides at least a portion of the power for the boost power mode; or at least 25% of the power for the boost power mode; or at least 50% of the power for the boost power mode; or all of the power for the boost power mode.

The FIGURE, shows a hose, 18, having a first end, 20, and a second end, 22. The first end is in fluid connection with the main body, 12, while the second end, 22, is in fluid connection with a handle, 24. The handle, 24, contains a button, 26, that is operatively-connected to a transmitter, 28. The handle, 24 of the FIGURE also contains a handle battery, 30, to power the transmitter, 28. The handle battery useful herein is typically a standard battery such as a disposable battery; or a 1.5 v AAA battery, a 1.5 v AA battery, a 1.5 v C battery, a 1.5 v D battery, a 9-volt battery, a watch battery, etc.

The transmitter and receiver (see 38, below) useful herein are mutually compatible such that a signal transmitted from the transmitter is receivable by the receiver. The transmitter may be a wireless transmitter and the receiver may be a wireless receiver. The signal may be a radio signal, a light signal, a sonic signal, an electric signal, a magnetic signal, and a combination thereof; or a radio signal, a light signal and a combination thereof; or a radio signal; or a light signal. A radio signal useful herein may be a Bluetooth™ signal, a Wi-Fi signal, a Z-Wave™ signal, a ZigBee™ signal, and a combination thereof; or a Bluetooth™ signal; or a Wi-Fi signal.

The Bluetooth™ signal useful herein may be an ultra high frequency radio signal in the 2.4 GHz to 2.4835 GHz band managed by the Bluetooth Special Interest Group and running the IEEE 802.15.1 standard. All variations of Bluetooth™ are typically useful herein including classic Bluetooth™, Bluetooth™ High Speed, as well as Bluetooth™ Low Energy. In an embodiment herein the Bluetooth™ transmitter and the Bluetooth™ receiver are paired prior to use; or paired during the shipping process; or paired during the manufacturing process. In an embodiment herein, the Bluetooth transmitter and the Bluetooth™ receiver are paired by the user.

The Wi-Fi signal useful herein may be an ultra high frequency radio signal in the 2.4 GHz band and/or the super high frequency 5 GHz band and based on the IEEE 802.11 standards and as regulated by the Wi-Fi Alliance. In an embodiment herein, sub-standards such as IEEE 802.11a, IEEE 802.11b, IEEE 802.11g, IEEE 802.11n, IEEE 802.11ac, and a combination thereof are also useful herein.

The Z-Wave™ signal useful herein may be a signal operating in the 900 range and the Z-Wave™ Standard as managed by the Z-Wave Alliance, and includes traditional Z-Waver™ signals as well as Z-Wave Plus™ signals.

The ZigBee™ signal useful herein may be a signal operating according to the IEEE 802.15.4 standard as regulated by the ZigBee Alliance. The ZigBee™ signal may be on different bands, worldwide, depending on the country and the local standard.

In an embodiment herein, the transmitter is a transceiver microchip.

In an embodiment herein, the receiver is a transceiver microchip.

In an embodiment herein the transmitter and/or the receiver is a Class 1 radio, Class 2 radio, and a combination thereof or a Class 1 radio.

In an embodiment herein, the signal is a light signal such as an infrared signal, an ultraviolet signal, and a combination thereof. In an embodiment herein, the transmitter contains a LED which transmits the signal; or a 940 nm wavelength LED. In an embodiment herein the transmitter and/or the receiver is a phototransistor.

In an embodiment herein, the transmitter and the receiver comprise an encryption key, and the signal is encrypted with the encryption key; or the signal is encrypted by the transmitter with the encryption key and decrypted by the receiver with the encryption key. In such a case, the actual encryption and/or decryption pay also take place in a PCB or other circuit operatively-connected to the respective transmitter and/or receiver; and or via software and/or firmware embedded in the transmitter and/or receiver. In an embodiment herein, the transmitter and the receiver comprise a security protocol; or a security protocol selected from the group consisting of WEP (Wired Equivalent Privacy), WPA (Wi-Fi Protected Access), WPA2 ((Wi-Fi Protected Access 2), WPA3 (Wi-H Protected Access 3, also known as WPA-OTP), EAP, SAFER+ block cipher, E22 algorithm, E0 stream cipher, Bluetooth PIN, Wi-Fi Protected Setup, pulse width modulated code, and a combination thereof.

In the FIGURE, a control circuit, 32, contains a PCB (printed circuit board), 34, which contains a timer, 36, operatively-connected to the control circuit, 32. In this case the tinier, 36, is a timing circuit embedded on the PCB, 34, but other types of timers known in the art are also useful herein. A receiver, 38, is also operatively connected to the control circuit, 32.

Typically, the control circuit, 32, regulates the speed of the pump, 14, and the draw from the electric batteries, 16 and 16', and permits the pump, 14, to normally operate at up to 100% normal power. In some embodiments herein, the control circuit may also permit the pump to operate at other levels below 100% normal power, such as 10% normal power, 25% normal power, 50% normal power, 75% normal power, etc. in some embodiments, the control circuit may allow the user may to operate the power washer at levels from about 1% normal power to about 100% normal power. In some embodiments the power washer herein will have a plurality of specific pre-set power level settings, and in other cases the control circuit may have a variable setting which allows power levels anywhere between about 0% normal power to about 100% normal power.

In the FIGURE, an optional AC power cord, 40, operatively-connects the power washer, 10, to an AC power supply, such as a local electrical grid. This AC power supply is then connected to the control circuit, 30, as well and is typically the main power supply for the power washer and to the control circuit. In such a case, the electric battery or batteries may provide at least a portion of the power for the boost power mode. In such a case, where the main power supply is an AC power supply, then the parameters of the 100% normal power mode will typically be dependent upon the pump tolerances, the circuit tolerances, safety and wear and tear tolerances, etc. rather than the battery draw tolerances.

The handle, 24, further contains a water output, 42, from where the high pressure water exits. The water output, 42, may further attach to and/or contain one or more spray heads which produce a variety of water spray patterns such as a stream, a fan, and a combination thereof. The handle, 24, further contains a trigger, 44, which activates the power sprayer, a grip, 46, for the user to securely hold the handle, and a guard, 48, which protects the user's hand during use.

The handle may further contain optional features, such as a power indicator, a boost mode indicator, a boost mode countdown timer, a second grip, and a combination thereof. Once activated, a boost mode countdown timer may indicate, for example, how many seconds of boost mode remain.

In an embodiment herein, the power washer, 10, ay be an AC/DC hybrid washer.

In an embodiment herein, the control circuit either directly or indirectly senses the temperature of the battery. If the temperature exceeds a predetermined temperature, then the control circuit terminates the boost power mode, even if the button is activated. In such a case, the control circuit will not allow the boost power mode to be operated until the temperature falls below the predetermined temperature. Furthermore, in such a case, an additional time delay may also be incorporated into the control circuit so as to allow the battery to cool down and recover for a period of time. The predetermined temperature may be, for example, at or below the temperature at which permanent damage occurs in the electric battery, the pump, to the control circuit, and/or to other power sprayer components.

After the boost mode is terminated, the control circuit may also provide a cool-down period; or a predetermined cool-down period. In an embodiment herein, the cool-down period is determined by actually sensing the temperature of the battery. In an embodiment of the present invention, the predetermined cool-down period is from about 1 minute to about 1 hour; or from about 2 minutes to about 30 minutes; or from about 2.5 minutes to about 20 minutes. The cool-down period is automatically started when the boost power mode terminates. During the cool-down period; or predetermined cool-down period, the control circuit will not operate the boost power mode, even if the button is activated by the user. Without intending to be limited by theory, it is believed that such a cool-down period prevents lasting damage to the power washer and its various components; or the battery; from resulting from over use of the boost power mode.

During use, the power of the pump of the power washer is boosted by providing the control circuit operatively-connected to the pump, providing an electric power source operatively-connected to the control circuit, providing a boost power mode, and terminating the boost power mode. The control circuit controls the pump. The electric power source is operatively-connected to the pump and the control circuit permits the pump to normally operate at up to 100% normal power. However, in the boost power mode, he control circuit permits the pump to operate at from about 103% normal power to about 300% normal power; or from about 105% normal power to about 250% normal power; or from about 110% normal power to about 200% normal power.

In an embodiment herein, a button is operatively-connected, either directly or indirectly to the control circuit; or is indirectly operatively-connected to the control circuit; or is operatively-connected to a transmitter whereas a receiver is operatively-connected to the control circuit and where when the button is activated the transmitter transmits a signal to the receiver as described herein. When the receiver receives the signal, then the receiver signals the control circuit to permit the pump to operate in the boost power mode. As noted herein, the transmitter may be a wireless transmitter and/or the receiver may be a wireless receiver.

The boost power mode is terminated after a predetermined period of time, or when the button is no longer activated, whichever period is shorter. Without intending to be limited by theory, it is believed that such a feature both allows the user greater control, and also reduces the change of damage to the battery, the pump, and/or the internal mechanisms of the power washer. Such a feature provides improved performance while maintaining the safety and reliability of the power washer. The predetermined period of time may be from about 2 seconds to about 10 minutes; or from about 5 seconds to about 2 minutes; or from about 7 seconds to about 1.5 minutes; or from about 10 seconds to about 1 minute; or from about 15 seconds to 45 seconds.

The electric power source may be an AC power supply, such as an AC power grid, and/or a DC power supply such as an electric battery.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

The invention claimed is:

1. An electric power washer comprising:

A. a main body comprising a pump and an electric power source, wherein the pump is operatively-connected to the electric power source;

B. a hose comprising a first end and a second end opposite the first end, wherein the first end is fluidly-connected to the pump;

C. a handle fluidly-connected to the second end, wherein the handle comprises a button; and D. a control circuit operatively-connected to the pump, and the control circuit operatively-connected to the electric power source, wherein the control circuit controls the output of the pump, wherein the control circuit comprises a timer operatively-connected to the control circuit, and wherein the button is operatively-connected to the control circuit, wherein the control circuit permits the pump to normally operate at up to 100% normal power, wherein when the button is activated, the control circuit permits the pump to operate at a boost power mode of from about 103% normal power to about 300% normal power, and wherein the control circuit intermittently pulses the boost power mode.

2. The electric power washer according to claim 1, further comprising a transmitter operatively-connected to the button and a receiver operatively-connected to the control circuit and wherein the transmitter transmits a signal to the receiver.

3. The electric power washer according to claim 2, wherein the transmitter is a wireless transmitter and wherein the receiver is a wireless receiver.

4. The electric power washer according to claim 3, wherein the handle further comprises a handle battery and wherein the transmitter is powered by the handle battery.

5. The electric power washer according to claim 2, wherein the signal is selected from the group consisting of a radio signal, a light signal, a sonic signal, an electric signal, a magnetic signal and a combination thereof.

6. The electric power washer according to claim 5, wherein the signal is a radio signal.

7. The electric power washer according to claim 5, wherein the signal is a light signal selected from the group consisting of an infrared signal, an ultraviolet light signal, and a combination thereof.

8. The electric power washer according to claim 2, wherein the transmitter and the receiver comprise an encryption key and wherein the signal is encrypted with the encryption key.

9. The electric power washer according to claim 1 wherein the control circuit terminates the boost power mode after a predetermined period of time or when the button is no longer activated whichever is shorter.

10. The electric power washer according to claim 1, wherein the electric power source comprises an electric battery.

11. The electric power washer according to claim 1, wherein the electric power washer comprises an AC power supply operatively-connected to the control circuit, and wherein the electric power washer is an AC/DC hybrid power washer.

12. The electric power washer according to claim 11, wherein the AC power supply is the main power supply to the control circuit and wherein an electric battery provides at least a portion of the power for the boost power mode.

13. A method of boosting the power of a pump on a power washer by the steps of:

A. providing a control circuit operatively-connected to the pump and wherein the control circuit controls the pump;

B. providing an electric power source operatively-connected to the control circuit, wherein the electric power source is operatively-connected to the pump and wherein the control circuit permits the pump to normally operate at up to 100% normal power;

C. providing a boost power mode, wherein for the boost power mode the control circuit permits the pump to operate at from about 103% normal power to about 300% normal power, and wherein the control circuit intermittently pulses the boost power mode.

14. The method according to claim 13, further comprising the steps of:

providing a button operatively-connected to a transmitter;

providing a receiver operatively-connected to the control circuit, and wherein when the button is activated, the transmitter transmits a signal to the receiver whereupon the receiver signals the control circuit to permit the pump to operate in the boost power mode.

15. The method according to claim 14, wherein the the transmitter is a wireless transmitter and wherein the receiver is a wireless receiver.

16. The method according to claim 14, further comprising the step of:

terminating the boost power mode after a predetermined period of time or when the button is no longer activated whichever is shorter.

17. The method according to claim 16, further comprising the step of:

providing a motor and a battery, the battery defined as the electric power source;

measuring a characteristic selected from the group consisting of a current usage, a battery temperature, a motor temperature, a pump temperature, a motor speed, a pump speed, and a combination thereof, and adjusting the predetermined period of time based on the characteristic.

18. The method according to claim 13, wherein the electric power source is an electric battery.

19. The method according to claim 13, further comprising the steps of providing a cool-down period, wherein during the cool-down period the control circuit will not start the boost power mode, even if the button is activated.

20. The method according to claim 13, further comprising the step of:

providing a motor and a battery, the battery defined as the electric power source;

measuring a characteristic selected from the group consisting of a current usage, a battery temperature, a motor temperature, a pump temperature, a motor speed, a pump speed, and a combination thereof, and adjusting the intermittent pulsing of the boost power mode based on the characteristic.

* * * * *